United States Patent [19]

Bartlett

[11] Patent Number: 4,926,159

[45] Date of Patent: May 15, 1990

[54] APPARATUS AND METHOD FOR THE GENERATION OF DIRECTIONALLY PERCEPTIBLE SOUND

[75] Inventor: Alan L. Bartlett, New Braunfels, Tex.

[73] Assignee: Detex Corporation, New Braunfels, Tex.

[21] Appl. No.: 220,025

[22] Filed: Jul. 15, 1988

[51] Int. Cl.[5] ..... G08B 3/00

[52] U.S. Cl. ..... 340/384 E; 340/384 R; 381/68.1; 381/68.2; 310/321

[58] Field of Search ..... 340/384 E, 384 R, 388; 381/68.1, 68.2, 98, 97; 310/320–322, 334; 368/255

[56] References Cited

U.S. PATENT DOCUMENTS 4,459,037 7/1984 Toyoda ..... 368/255

4,486,742 12/1984 Kudo et al. ..... 340/384 E

*Primary Examiner*—Donnie L. Crosland

*Attorney, Agent, or Firm*—Arnold, White & Durkee

[57] ABSTRACT

An apparatus and method to generate high intensity sound having a strong directional characteristic. The apparatus preferably uses a sound element (e.g. piezo sounder) which is capable of generating a high intensity, power efficient sound, but which has poor directional characteristics because of its high frequency (e.g. 3000 Hz). The apparatus drives the sound element with a variable frequency signal which sweeps across the resonant bandwidth of the sound element. The sweep rate of the frequency shift is less than about 1200 Hz which gives the sound a directional characteristic—resulting in periodic bursts of high intensity sound that is strongly directional. The apparatus may be incorporated into a wide variety of applications where high intensity, power efficient, strongly directional sound is desirable. In the preferred embodiment, the sound generator of the present invention is incorporated into a personal alert warning device worn by fireman or other safety personnel to emit a directional sound if the wearer becomes disabled.

18 Claims, 5 Drawing Sheets

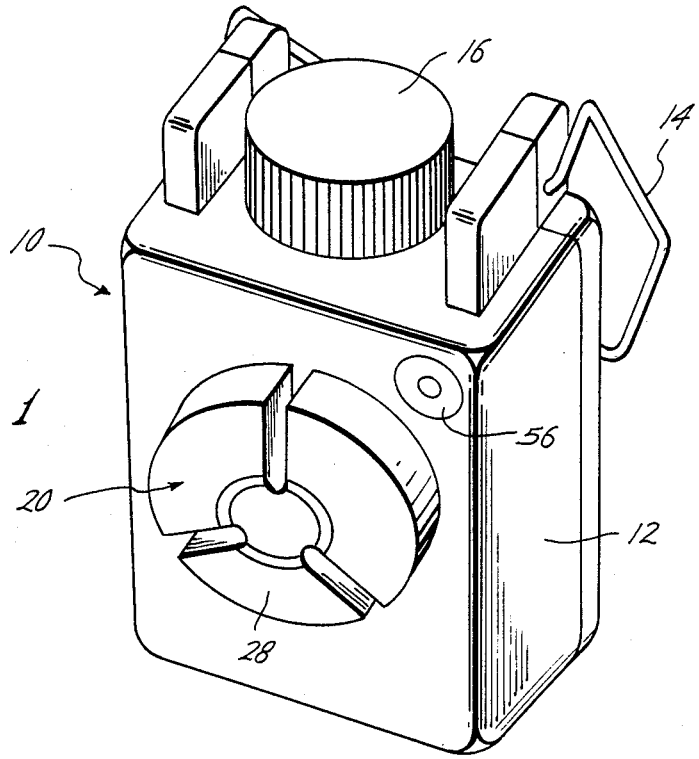
Fig. 1
Fig. 2
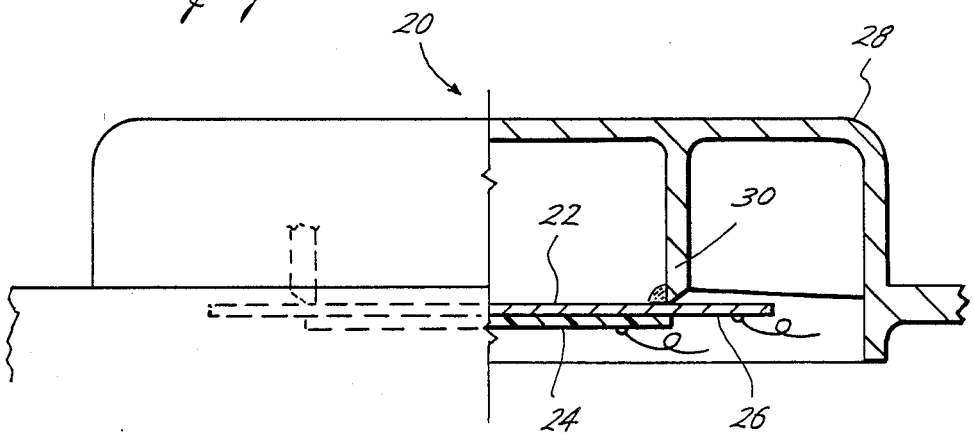

APPARATUS AND METHOD FOR THE GENERATION OF DIRECTIONALLY PERCEPTIBLE SOUND

BACKGROUND OF THE INVENTION

1. Field of the Invention

This invention relates to sound generators and more particularly to an apparatus and method for the generation of high-intensity "directionally perceptible" (i.e., locationally discernible) sound. In one application, the sound generator hereof is used in a personal alert safety system to facilitate the location of lost personnel where it is important that a human determination be quickly made as to the direction to the sound source.

2. Description of the Related Art

Some sound sources appear to have better directionality than other sound sources. Typical examples of sound sources with good directional characteristics are foghorns and air actuated horns frequently used on large trucks. Such devices are large in size, heavy in weight and require large power inputs and are, therefore, unsuitable in many applications. Additionally, clapper, vibrating, or diaphragm horns, typical of electric auto horns or bicycle horns, have some direction qualities. However, these horns also have objectional electrical characteristics related to power conversion and inductive circuits which complicate their use.

Piezoelectric transducers in sound generating devices are power efficient, small in size, and light in weight, and when mounted in suitable resonant chambers are capable of generating high intensity sound at low power inputs. The resonant frequency of such piezoelectric transducer is, however, high, typically on the order of 3000 Hz and above, and appear to have little directionality of sound, at least with human beings.

Several different techniques have evolved to utilize piezoelectric transducers as sound generators. These techniques include amplitude modulation of the oscillating power signal energizing the resonator at a rate between about 200 and 800 Hz, so that the sound output of the generator is amplitude modulated at that rate. Such devices require a discrete oscillator in an external drive configuration to generate the signals for exciting the resonator for high sound levels. Environmental stability of the resonator and of the decoupled driving oscillator with an amplitude modulated output, are not easily achievable, nor is it easy to match the resonator and oscillator frequencies in the first place. Mismatching of resonator and oscillator frequencies results in a serious diminution of sound intensity.

Another solution is to utilize wide band sound transducers which are relatively insensitive to drift in the frequency of the energizing source. However, wide band sound transducers are not resonant and therefore are inefficient, requiring relatively large power inputs for comparable sound intensity.

Still another technique is to utilize two or more resonant transducers or a single resonant transducer having multiple resonant frequency outputs. The generation of two sound sources of relatively high nondirectional frequency creates a beat frequency which may be directionally perceptible. The most conspicuous disadvantage of using beat frequency devices is that only approximately 25 percent of the radiated sound is converted into the directionally perceptible lower frequency beat. Not only is the majority of the sound wasted for directional purposes, but it tends to overpower the beat note. See e.g., U.S. Pat. No. 4,486,742.

SUMMARY OF THE INVENTION

A low power, high intensity sound generator with perceptible sound directionality is achieved by the method and apparatus of the present invention. The present invention theorizes that better sound directionality is achieved at lower frequencies, such as below about 1200 Hz, and provides a method for energizing a sound generator having a resonant frequency exceeding 1200 Hz (i.e. normally poor sound directionality). For example, the present invention can energize a piezoelectric resonator at approximately its resonant frequency (e.g. 3000 Hz) to achieve a low power, high intensity sound with directional characteristics. The energizing signal is frequency modulated over a range which includes the dominant resonant frequency of the piezoelectric resonator. The frequency sweep rate is less than about 1200 Hz, resulting in an amplitude modulated directionally discernible sound.

Broadly speaking, the apparatus of the present invention includes a resonator means responsive to A.C. signals for generating an audible sound and an oscillator for supplying a variable frequency A.C. signal to the resonator means. The resonator means has a resonant frequency in excess of about 1200 Hz. As used in the present application, the term "resonant frequency"0 includes a single discrete frequency, a narrow bandwidth, a wide bandwidth, or even two or more localized maxima in a frequency bandwidth, at which the amplitude of the sound intensity is maximized. The oscillator is operable for frequency modulating the A.C. signal over a frequency shift that includes the resonant frequency of the resonator. The sweep rate of the frequency modulation by the oscillator over the shift range is less than about 1200 Hertz to give the sound directionality.

In a preferred form, the resonator means of the apparatus of the present invention is a piezoelectric sound element or includes a piezoelectric sound element operatively received in a resonating casing. Preferably, the piezoelectric sound element has a resonant frequency centered about 2.9 KHz and a bandwidth of about 500 Hz with the oscillator producing variable frequencies over a frequency shift range including about 2.0 KHz to 3.6 KHz. In a preferred form, the oscillator means is coupled to a microprocessor which serves to gate on the supply of the A.C. signal energizing the resonator means.

The method of the present invention broadly includes the steps of providing a resonator responsive to A.C. signals and having a resonant frequency in excess of about 1200 Hz, and supplying a variable frequency A.C. signal to the resonator to generate an audible sound. The A.C. signal is frequency modulated over a frequency shift that includes the resonant frequency, and the sweep rate of the frequency modulation is controlled across the shift range at a rate less than about 1200 Hertz.

In accordance with a preferred embodiment of the invention, a resonator comprising a nodally supported piezoelectric sound element in a resonant chamber is energized by an external drive circuit—preferably a frequency modulated oscillator. The output of the oscillator is frequency modulated above and below the resonant frequency of the sound element by amounts which are preferably substantially in excess of the resonant bandwidth of the piezoelectric element. The sweep rate of the frequency modulation is selected at a value which is directionally discernible by the human ear, i.e., below 1200 Hz. Thus, the resonant bandwidth of the piezoelectric element (e.g. 500 Hz), is swept by an output signal at a rate less than 1200 Hz. As a result, the dominant resonant frequency output of the sound element (e.g. 3000 Hz, substantially above the threshold which is directionally discernible to the human ear) will appear as an amplitude modulated sound at a frequency below about 1200 Hz, giving resonant bursts of sound having directional characteristics.

In the preferred embodiments of the invention, the piezoelectric sound element has a resonant frequency about 500 Hz wide centered about 2.9 KHz. The oscillator signal driving the piezoelectric element is frequency modulated over a shift range from 1.9 to 3.9 KHz, at a frequency sweep rate about 290 Hz. Thus, the sound output frequency of the piezoelectric element of approximately 2.9 KHz will be amplitude modulated at the same rate as the sweep frequency (e.g. 290 Hz). This amplitude modulation occurs because the piezoelectric element will be excited to its peak-energy acoustical output each time its resonant frequency is matched by the output frequency of the oscillator.

In the preferred embodiment, the oscillator mechanism includes a timing circuit which is configured to function as two astable multivibrators—a modulator vibrator and a fundamental oscillator. Operation of the timing circuit is initiated by a microprocessor, which is essentially functioning as an on/off gate. Upon initiation of the timing circuit, the modulator vibrator generates a triangular voltage through a resistance capacitance network which is fed to the fundamental oscillator. The fundamental oscillator generates a sound element energizing signal which is frequency shifted by the variable voltage from the modulator vibrator.

A principal advantage of the present invention is that a sound generator normally having poor directional characteristics can be energized in such a fashion to generate a directionally discernible sound. Thus, small, compact, power efficient sound generators such as piezoelectric elements can be operated to generate a high intensity power efficient sound having directionality.

Another advantage of the present invention is that by exciting a piezoelectric element with a frequency modulated power signal, the effects of frequency mismatching between the driver oscillator frequency and the resonant frequency of a piezoelectric element having a "narrow resonant bandwidth"0 are decreased. Accordingly, as the driver frequency of the frequency modulated power signal sweeps across the frequency deviation band about the resonant frequency, the chance of not exciting the piezoelectric element at its peak resonant frequency is extremely small. Even with dramatic swings in ambient temperature which shifts the resonant bandwidth of the piezoelectric element, the frequency modulated driving signal will excite the piezo element at its peak resonant frequency. This feature of the present invention thus reduces the sensitivity of driver oscillator mismatching, and also reduces high quality control conditions which are otherwise required to match the resonant bandwidth of the piezoelectric element and the frequency of the driver oscillator.

BRIEF DESCRIPTION OF THE DRAWINGS

FIG. 1 is a perspective view of a personal alert safety system including the directionally perceptible sound generator of the present invention;

FIG. 2 is an enlarged, fragmentary, side elevational view in partial section of the piezoelectric element in the resonator casing of the present invention;

FIG. 4A shows the control voltage sweep from about 2 volts to 3.5 volts to the fundamental oscillator, FIG. 4B shows the oscillator waveform output from the fundamental oscillator corresponding to control voltage sweep of FIG. 4A, FIG. 4(C) shows the amplitude modulation envelope as the frequencies are swept across the resonant frequency bandwidth, FIG. 6(A) shows the 3.33 millisecond time period, FIG. 6(B) shows the square wave pulses output from the microcomputer, and FIG. 6(C) shows the amplitude modulation envelope as the step pulses of FIG. 4(B) sweep in the frequency shift range.

DETAILED DESCRIPTION OF THE PREFERRED EMBODIMENT

Figure 3:
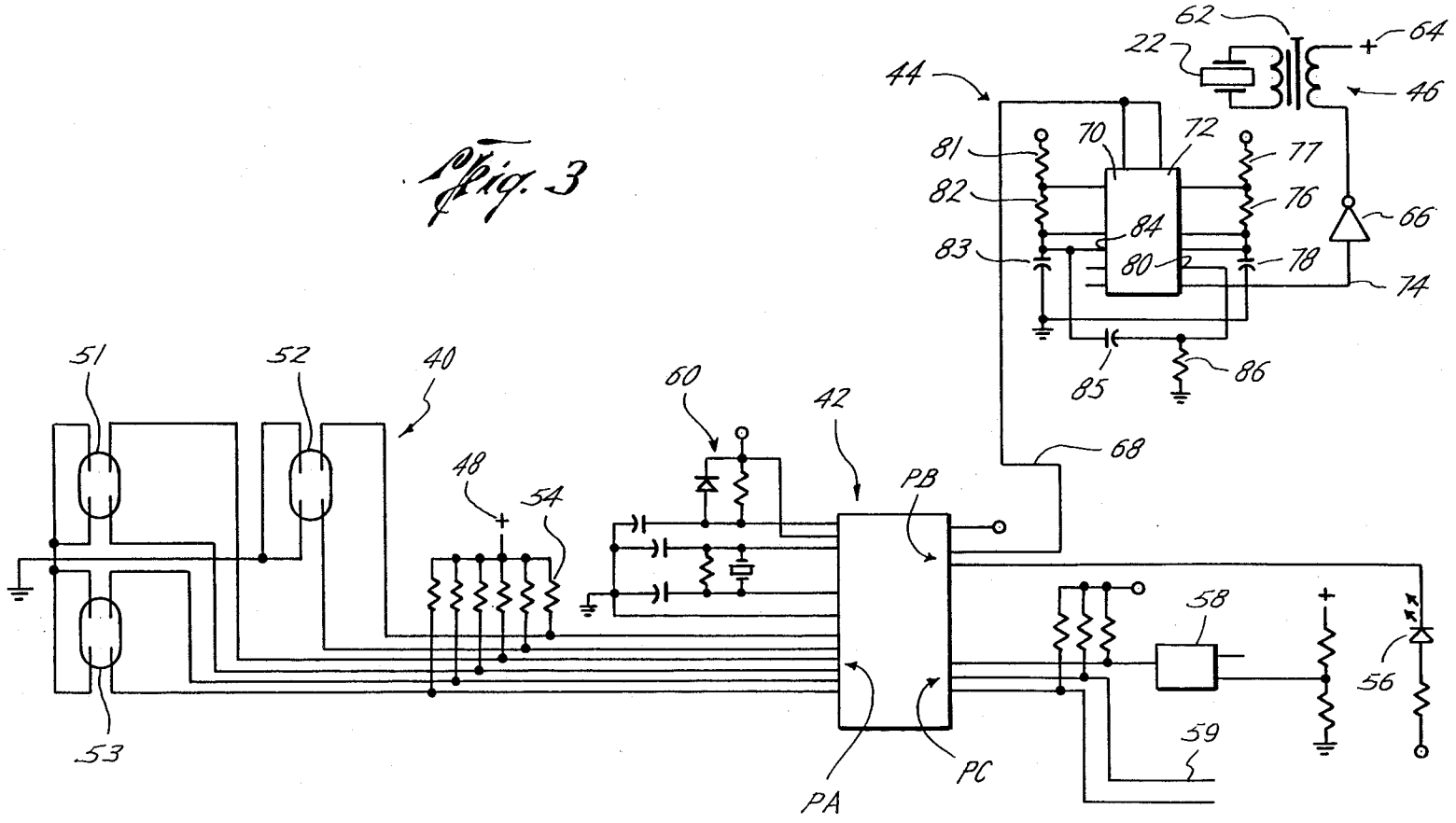
FIG. 3 is a circuit schematic of the personal alert system of FIG. 1 incorporating the sound generator hereof.

Turning to the drawings, FIGS. 1–4 illustrate a preferred embodiment of the directionally discernible sound generator of the present invention incorporated into a personal alert warning device 10. As shown in FIG. 1, the personal alert device 10 includes a housing 12 with a clip 14 for attaching the device 10 to a person. A switch is coupled to the housing 12 and preferably is a two motion switch which requires a push and turn movement to position the switch out of the off position. The switch is three positioned for operating in the on, off, and automatic modes.

On the front of the housing 12 is a resonator assembly 20. The resonator assembly 20 includes, as best seen in FIG. 2, a disk-shaped piezoelectric sound element 22 (such as the piezoelectric buzzers, Model Nos. 7BB-20, -27, -35, and -41, made by Murata Corporation) in which the disk-shaped crystal 24 is centrally mounted on a metallic carrier plate 26 which forms one electrode of the piezoelectric crystal 24. The other electrode constitutes a silver coating (not shown) on the oppose side of the disk shaped crystal 24. A terminal is formed on the silver coating on the lower side of the crystal 24 near the outer edge thereof and a second terminal is formed on the underside of the metallic plate 26 at a point between the outer edge of the crystal 24 and the outer edge of the metal plate 26.

The resonator assembly 20 includes a casing 28 defining a tuned resonant chamber for receiving the piezoelectric sound element 22. Slots are provided (FIG. 1) to direct the acoustic energy upwardly and outwardly in three directions. The configuration of the slots and chamber tune the frequency of the output of the piezo sound element 22. A nodal mounting of the piezoelectric sound element 22 is preferred because of its ability to achieve maximum audio output. To this end, a cylindrical boss 30 is formed within the casing 28 having a diameter corresponding to the diameter of the circular node of the sound element 22. In the illustrated embodiment, this corresponds approximately to the diameter of the crystal 24.

The piezoelectric sound element 22 is secured to the mounting boss 30 by means of an adhesive (e.g. silicone resin) which affords elasticity, thermal resistance, and moisture resistance. The resin bead mounting the element 22 is preferably kept uniform and at a minimum value in order to least impede upon the Q of the resonant assembly The vibration mode established by this nodal mounting is such that the central portion of the sound element 22 bows upward and downward within the chamber while the peripheral portion (radially beyond the mounting boss 30) flexes in the opposite direction.

Turning now to FIG. 3, an electrical schematic of the warning device 10 is illustrated and broadly includes a switch circuit 40, microcomputer 42, oscillator circuit 44, and horn system 46. In more detail (left hand side of FIG. 3), the switch circuit 40 includes three mercury switches 51–53. Each mercury switch 51–53 is a double switch-type packaged in a cylindrical or crescent-shaped tubular enclosure. Each enclosure is elongated and includes a pool of mercury shiftably disposed therein. As can be seen from FIG. 3, one end of each mercury switch 51–53 includes a pair of contacts (e.g. hot contact and ground contact), while the other end also includes a pair of contacts (hot and ground).

The microcomputer section 42 is largely self-explanatory from the circuit diagram, and of course the principal component is the microprocessor (e.g. Motorola MC 1468705F2CS). Ports PA are operably interconnected to the hot contacts of the switches 51–53 as shown in FIG. 3. For example, the top port PA0 is connected to a contact at one end of mercury switch 52, while the next port PA1 is connected to the opposite end hot contact in mercury switch 52. A power supply 48 is illustrated schematically to power the lead lines to ports PA across resistors 54 (e.g. 47 ohms). In the preferred embodiment, the power supply 48 is a conventional nine volt battery, stepped down (not shown) to supply a regulated five volt power source.

LED 56 is connected to the microprocessor 42 (port PB1) and is controlled to indicate battery state. Hysteresis sensor 58 is powered at nine volts, while lead 59 interconnects the switch 16 (FIG. 1) with the microcomputer 42 (port PC1) for enabling the automatic mode. An external clock circuit 60 provides timing to the microcomputer 42, as shown.

The horn system 46 includes the piezoelectric sound element 22 operatively connected to transformer 62. The transformer 62 is powered at nine volts from the battery as at 64. The transformer 62 is connected to inverter 66, which provides the interface between the oscillator circuit 44 and horn system 46. It should be noted that the inverter 66 may optionally be a field effect transistor. As can be seen in FIG. 3, the microcomputer 42 is connected to the oscillator circuit 44 through the reset line 68.

In more detail, the oscillator circuit 44 is a dual timing circuit such as an IC7556 made by Maxim Incorporated or Intersil Signotics, Inc. The oscillator circuit 44 is configured to function as two astable multivibrators, labeled broadly in the drawing as modulator vibrator 70 (left side in the drawing) and fundamental oscillator 72 (right side in the drawing). The fundamental oscillator 72 drives the inverter 66 through the output pin and line 74. The fundamental oscillator's frequency is determined by the values of resistors 76, 77 and capacitor 78. The modulator vibrator 70 (left side of the timer) supplies the control voltage to the fundamental oscillator 72 (right side of the timer) at the control voltage input pin 80. The modulating frequency output from the modulator vibrator 70 at pin 84 is determined by the values of the resistors 81, 82 and capacitor 83 connected in an R/C network as shown.

As can be appreciated from the drawing, the output of the modulator vibrator 70 from output pin 84 is integrated by capacitor 85 and resistor 86 to produce a triangular voltage on the fundamental oscillator 72 at control voltage pin 80.

OPERATION OF THE PREFERRED EMBODIMENT

The directionally discernible sound generator of the present invention as shown in the preferred embodiment is incorporated into a personal alert warning device 10. In such an application, the alert device 10 is worn by a person to generate an alarm when "normal"0 or "valid"0 motion of the person ceases. For example, such a personal alert warning device 10 might be worn by a firefighter, miner, prison guard, chemical worker, etc., where it is desirable to monitor the wearer's physical status. If the wearer becomes disabled, the personal alert warning device is designed to generate a warning signal so that the person can be located and rescued. The directionally discernible sound generator of the present invention is particularly useful in such an application in that the directional sound generated by the device 10 when the wearer is disabled enables rescue workers to more readily find the disabled worker. The operation of the device 10 is more fully explained in U.S. Patent Application Ser. No. 153,162, filed Feb. 8, 1988, incorporated herein by reference.

The alert device 10 of FIG. 1 has two operating modes depending on the position of switch 16—"on"0 and "auto". In the "on"0 condition the microcomputer 42 is enabled for immediate operation of the resonator assembly.

More commonly, the switch 16 is placed in the "auto"0 mode with the microcomputer 42 monitoring the output of the mercury switches 51–53 to determine when "valid"0 or normal motion is not present. In the "auto"0 mode of operation, the mercury switches 51–53 are continuously sampled as inputs considered by the microcomputer 42. Active movement of the wearer will cause the mercury in the switches 51–53 to establish electrical connects and disconnects between the contacts at each end of the switch enclosures. Preferably, the three mercury switches 51–53 are mounted about 90° relative to each other to sense motion in each of three planes.

In the illustrated embodiment "valid"0 motion is defined as requiring any of the mercury switches 51–53 to make and break electrical contacts at each end of the respective switch at least once within the chosen time period (usually about 20 seconds). Alternatively, "valid"0 motion can be defined as desired by appropriate programming of the microcomputer 42, such as requiring more than one of the mercury switches 51–53 to make or break contact within a certain time period. Of course, in some applications only one mercury switch or other type of motion sensing device might be adequate to determine valid wearer motion.

As can be appreciated, the function of the switch circuit 40 is to sense motion while the function of the microcomputer 42 is to determine whether the inputs from the switch circuit 40 constitute valid motion according to its programmed definition. As illustrated, the microcomputer 42 senses motion from the switches 51–53 on the 6 ports labeled PA. The microcomputer 42 also monitors battery condition through port PC0 while the first port PB0 is connected to LED 56 to provide a visual indication of the battery status and operation of mode of the device 10 (see FIG. 1).

In the preferred embodiment, the function of the microcomputer 42 is simply to provide an on/off gating signal to the oscillator circuit 44 through reset line 68. That is, the modulator vibrator 70 and fundamental oscillator 72 are enabled when the oscillator circuit 44 receives a positive voltage on reset line 68 from the microcomputer 42. The modulator frequency (FM) is determined by the values of resistors 81, 82 (18.2K and 15.0K ohms as illustrated) and value of the capacitor 83 (0.1 microfarad as illustrated) according to the following relationship:

*Modulator Frequency*
$$(FM)=1.46/(R81+2\times R82)C83$$

Figure 4A:
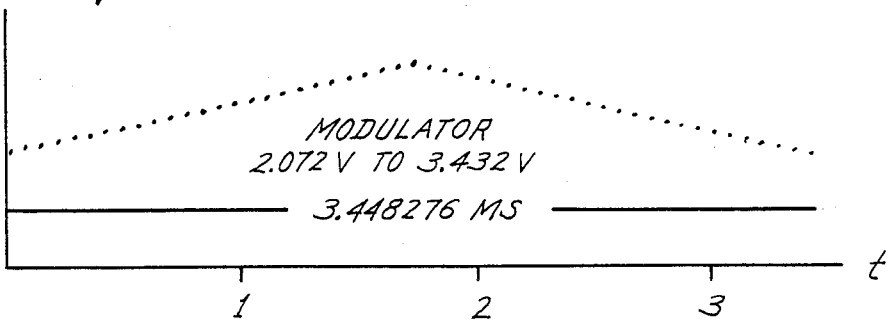
FIGS. 4A–C are a graphic representation over about a 3.5 millisecond time period where

Thus, the modulator frequency (FM) is approximately 290 Hz for the circuit shown. The output from output pin 84 is integrated by capacitor 85 (0.1 microfarad) and resistor 86 (92.5K ohms) to produce a triangular voltage to the fundamental oscillator 72 at the control voltage pin 80. The control voltage varies from approximately 2 volts to 3.5 volts as shown in FIG. 4(A).

The fundamental oscillator frequency (OF) is determined by the components R76, R77 and C78 according to the following relationship:

*Fundamental Oscillator Frequency*
$$(OF)=1.46/(R77+2\times R76)C78\ KHz$$

The fundamental oscillator frequency (OF) is approximately 2 KHz for the circuit shown in the drawing of FIG. 3 (R76=2.74K ohms, R77=2.21K ohms, C78=0.1 microfarad) when no voltage is applied to control voltage pin 80. The fundamental oscillator frequency (OF) is frequency shifted by the control voltage (VM) received at pin 80 according to the following relationship:

$$OF=1.47\ (4.724\text{-}VM)KHz$$

Figure 4B:
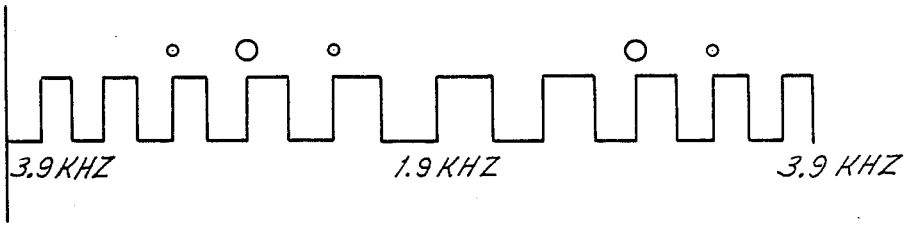

Thus, the output of the fundamental oscillator 72 at output line 74 is a variable frequency which for the illustrated embodiment varies from about 1.9 KHz to 3.9 KHz as the control voltage VM shifts from about 2.0 to 3.4 volts. A comparison of FIGS. 4(A) and 4(B) shows the relationship of the frequency modulation output (OF) from the fundamental oscillator 72 as a function of control voltage (VM) from the modulator vibrator 70. The frequency modulated output (OF) at line 74 is current amplified by the inverter 66, while the transformer 62 steps up the voltage to approximately 80 volts rms.

Figure 4C:
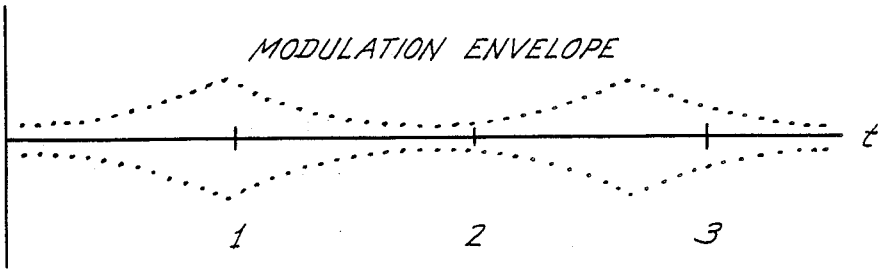

The piezo sound element 22 is mounted in the casing 28 and has a resonant frequency centered about 2.9 KHz at 80° F. In FIG. 4(C), the sound output is plotted versus the 3.5 millisecond time period of FIGS. 4(A) and 4(B), and shows reaching about a 95 dB resonant peak at approximately 1 millisecond and 2.7 millisecond. In FIG. 4(C), the resonant bandwidth is defined as about 500 Hz and the sound output is seen to decrease by 3 dB or greater when the fundamental oscillator frequency (OF) differs from the resonant frequency by amount greater than or equal to the bandwidth. In FIG. 4(B) the symbols "o"0 depicts the approximate resonant bandwidth.

Viewed in another way, FIGS. 4(A)–4(C) illustrates a 3.5 millisecond time period in the operation of the oscillator circuit 44 and horn system 46, where the modulator frequency (FM) is 290 Hz, the fundamental oscillator frequency (OF) shifts 1000 Hz, and the resonant bandwidth is about 500 Hz centered about 2.9 KHz. The shifting control voltage of FIG. 4(A) from the modulator vibrator 70 is used to produce the frequency modulation illustrated in FIG. 4(B) from the fundamental oscillator 72. The frequency modulation of FIG. 4(B) produces an amplitude modulation as seen in FIG. 4(C) as the frequency (OF) of the signal driving the horn system 46 is swept across the resonant bandwidth. As the driving frequency (OF) sweeps through the resonant bandwidth a sharp sound amplitude modulation occurs and rapidly falls off as the driving frequency (OF) passes the resonant bandwidth. A burst of 3 KHz sound is generated every time the driving frequency (OF) is swept across the resonant peak. As illustrated, this sound burst lasts less than a millisecond and is repeated about every 2 milliseconds. The 290 Hz modulation or sweep rate (FM) has been found to give a sound which has superior directional characteristics as perceived by humans.

Without being bound by theory, it is believed that directional sound perception is achieved at or below about 1200 Hz. Humans are believed to determine sound direction by comparison of the phase difference between the sound heard in one ear and the sound heard in the other ear. This phase difference is zero if the human is facing the sound source, and is a maximum with the sound coming from the right or left. Thus it is believed that frequency modulation or sweep rate (FM) will give directional sound at values below about 1200 Hz.

It is believed that maximum sound directivity is achieved with the sound coming from right or left and with a frequency corresponding to a wavelength greater than twice the distance between the two ears. This wavelength minimum is based on the Nyquist criterion used in broadcasting standards that states that for a signal with a bandwidth $f_o$, the sampling frequencies should be equal to or greater than 2 $f_o$—i.e. twice the bandwidth of the signal being sampled. Therefore, the Nyquist criterion states that more than two data samples per cycle are required to prevent ambiguities. Based upon a velocity of sound in air of 34,400 cm/sec (at standard temperature) and an approximate upper limit on ear spacing at 14 cm, the approximate maximum frequency for phase perception is about 1200 Hz. Therefore, Applicant believes that at frequencies less than about 1200 Hz the sound directivity is best achieved (at standard temperature and pressure conditions).

The present invention is particularly useful in that it may be used to give a directional characteristic to an electromechanical sound generator which has normally poor sound directional characteristics. That is, piezoelectric sound generators are desirable in many applications in that they are compact and power efficient; unfortunately they generate a high pitched sound (about 3000 Hz) having poor sound directivity. The present invention frequency modulates the driving circuit of such a piezoelectric element to achieve a compact, power efficient amplitude modulated sound having excellent sound directivity characteristics.

ALTERNATIVE EMBODIMENTS

Figure 5:
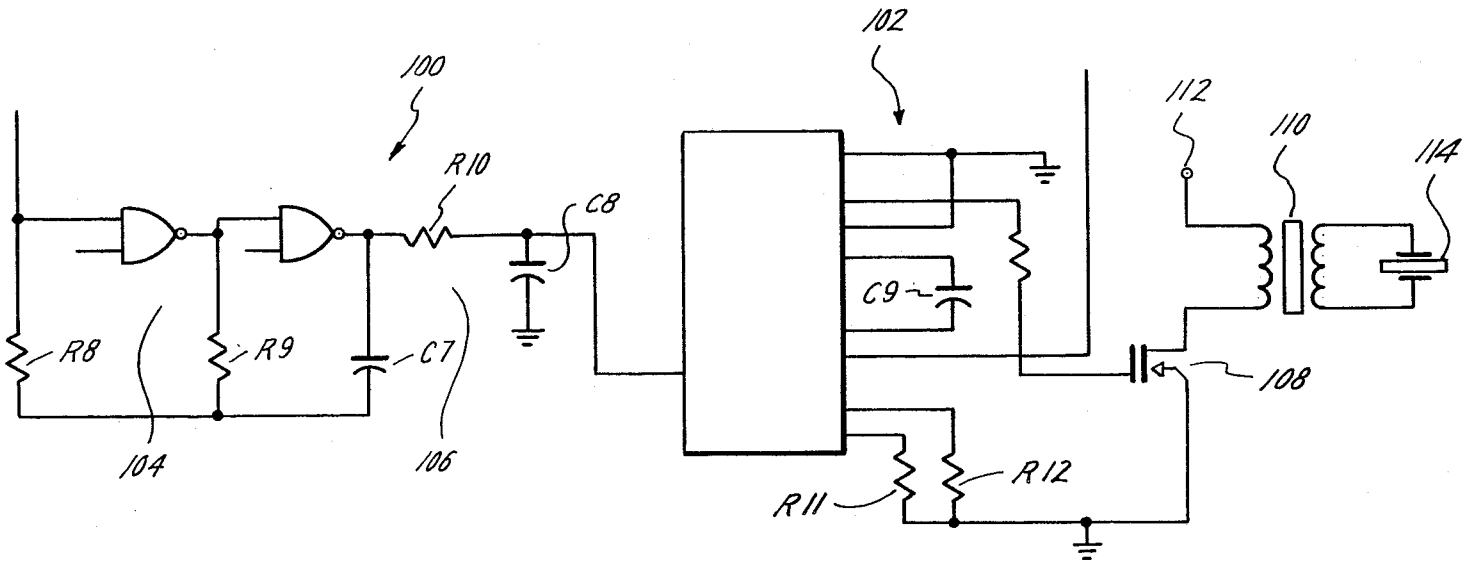
FIG. 5 is a schematic diagram of an alternative embodiment of the directionally discernible sound generator hereof.

While the preferred embodiment shows the directional sound generator of the present invention incorporated into a personal alert warning device, such a sound generator can be incorporated into a wide variety of applications. For example, FIG. 5 illustrates an alternative embodiment in which the sound generator is incorporated into a door exit alarm system to generate a directional sound when a door is opened. FIG. 5 also illustrates that a variety of different types of electrical components can be implemented to generate the desired frequency modulation of a resonator assembly.

In the embodiment of FIG. 5, the function of the modulation vibrator 70 is performed by the signal modulator 100, while the function of the fundamental oscillator 72 is performed by the voltage controlled oscillator 102. That is, the output of the signal modulator 100 is a periodic triangular waveform similar to FIG. 4(A) at a modulator frequency (FM) less than about 1200 Hz.

In more detail, the signal modulator 100 comprises square-wave generator 104 and integrator 106, with the square-wave generator 104 comprising a resistive-capacitive (RC) oscillator configured by two CD4011 NAND gates wired as shown. The frequency of oscillation (fs) output from the square-waver generator 104 is represented by the formula:

$$fs = \frac{1}{1.4\,R_9C_7}$$

where $R_9$ and $C_7$ function as timing resistance and capacitances, respectively. In the embodiment shown, $R_9$ is 470K ohms and $C_7$ is 0.01 microfarad, and thus the frequency of oscillation fs is about 152 Hz.

The integrator 106 of FIG. 5 comprises a resistance $R_{10}$ of 15K ohms and a capacitance $C_8$ of 1.0 microfarad. The periodic square waveform output of the squarewave generator 104 is integrated by the integrator 106 to provide a 0.0 to 5.0 volt approximation of a periodic triangular waveform. This triangular waveform functions as the modulation signal (VM) which is provided as the control input of the voltage controlled oscillator 102.

The voltage controlled oscillator 102 comprises the voltage controlled oscillator (VCO) section of a CN4046 phase locked loop (PLL) integrated circuit (IC) chip configured within a resistive and capacitive network. Capacitive and resistive components $C_9$ and R11 and $R_{12}$, respectively, determine the oscillator frequency (OF) in a fashion similar to FIG. 4(B).

With a resonator assembly 20 having a resonant frequency of about 2.9 KHz and a resonant bandwidth B of about 500 Hz, the voltage controlled oscillator 102 preferably should produce a driving signal which sweeps from about 2.0 KHz to about 3.5 KHz. A periodic triangular modulation signal (VM) from signal modulator 100 having a 0–5 volt peak-to-peak voltage swing will produce the desired frequency shift of the driving signal.

Figure 6A:
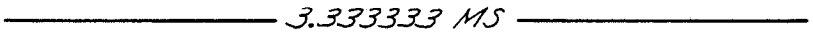
FIGS. 6A–C are a graphic representation of the output of an alternative embodiment where
Figure 6B:
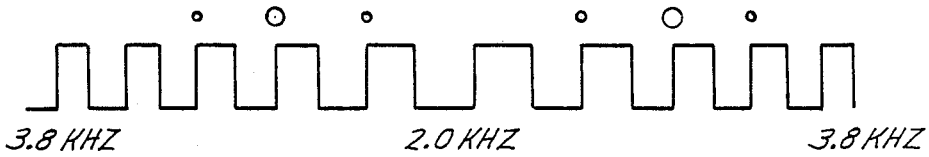
Figure 6C:
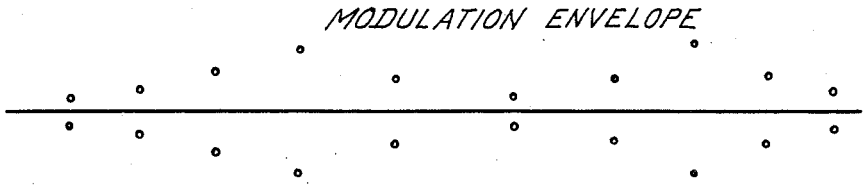

A linear power amplifier is provided by a Field Effect type power transistor 108 of the type MTP3055E connected in series with the primary coil of transformer 110. The piezo sound element 114 is electrically connected to the secondary coil of the transformer 110 in order to step up the drive voltage to the piezo element Still another embodiment of the invention is known, where the microcomputer generates the frequency modulation of the signal driving the piezo element. FIGS. 6A–C show the output of a sound generator in accordance with the present invention in which the 556 timer is eliminated and the oscillator circuit function is picked up by the microcomputer 42. That is, in FIG. 3, the oscillator circuit 44 is eliminated, and the reset line 68 runs directly from the microcomputer 42 to the inverter 66 (or alternatively a field effect transistor).

In this embodiment, the output of microcomputer 42 is a stepwise approximation of a frequency shift that sweeps through a frequency shift range that includes the resonant frequency bandwidth of the piezoelectric element 22. That is, instead of simply providing a reset to the 556 timer as shown in FIG. 3, the microcomputer 42 is programmed to generate square wave pulses equal to ½ cycle of the output frequency.

Turning to FIGS. 6A–C, an example of the functioning of this alternative embodiment is illustrated. In FIGS. 6A–C the frequency modulation or sweep rate across the frequency shift range is about 300 Hz (i.e. less than 1200 Hz to provide sound directionality). The resonant bandwidth is approximately the same as illustrated in FIGS. 4A–C, that is piezoelectric element 22 has a resonant peak approximately 2.9 Hz with a bandwidth of plus or minus 500 Hz. As in the preferred embodiment, the frequency shift range should ideally be approximately twice the bandwidth, and in FIG. 6(B) the frequency shift range is 900 Hz. In FIG. 6(A), the 3.33 time period is illustrated; in FIG. 6(B) the square wave pulses generated by the microcomputer 42 are plotted with the resonant bandwidth illustrated by "o's"0 imposed over the frequency shift range; while in FIG. 6(C) each dot represents the level of sound intensity produced for each pulse from the microcomputer 42 illustrated in FIG. 6(B).

The square wave pulses produced by the microcomputer 42 illustrated in FIG. 6(B) is preferably equal to ½ cycle of the output frequency. For example, at resonant frequency of 2.9 KHz a step is 0.344 milliseconds. As can be appreciated from FIGS. 6(B) and 6(C), one or more of the frequency steps must fall within the range of the resonant frequency plus or minus the bandwidth to produce the amplitude modulation. As in FIG. 4, the sound output from the resonant system in FIG. 6(C) is observed at a peak when the driving frequency is at the resonant point (2.9 Hz at 80° F.) and to decrease by about 3 dB when the driving frequency differs from the resonant frequency by an amount equal to the bandwidth. As can be seen, the frequency modulation of FIG. 6(B) produces the amplitude modulation of FIG. 6(C), and because the sweep rate is 300 Hz (below 1200 Hz) the output is sound directional.

What is claimed is:

1. Apparatus for generating a directionally discernible sound comprising:

resonator means responsive to an A.C. signal for generating an audible sound and having resonant frequency in excess of 1200 Hz;

oscillator means for supplying a variable frequency A.C. signal to said resonator means and for frequency modulating said A.C. signal at a sweep rate over a frequency shift range that includes the resonant frequency of the resonator means, the sweep rate of said frequency modulating over said shift range being less than about 1200 Hz.

2. The apparatus according to claim 1, said resonator means including an electromechanical device for producing said audible sound.

3. The apparatus according to claim 1, said resonator means including a piezoelectric sound element.

4. The apparatus according to claim 3, said resonator means including a resonating case operatively receiving said piezoelectric sound element.

5. The apparatus according to claim 3, said piezoelectric sound element having resonant frequency bandwidth including a single dominant resonant point.

6. The apparatus according to claim 5, the resonant frequency bandwidth being about 2.9 KHz+or −500 Hz at about room temperature.

7. The apparatus according to claim 5, said oscillator means being operable for producing a frequency modulated A.C. signal over a frequency shift including the range of about twice the bandwidth of the resonant frequency.

8. The apparatus according to claim 7, said sweep rate over said bandwidth being about 200–600 Hz.

9. The apparatus according to claim 1, said oscillator means including a timer circuit for producing said frequency modulated A.C. signal.

10. The apparatus according to claim 9, said timer circuit comprising a 556 type RC timer.

11. The apparatus according to claim 1, including a microprocessor coupled to said oscillator means for initiating the supply of said A.C. signal.

12. The apparatus according to claim 1, said oscillator means including a microprocessor for supplying the frequency modulated signal to the resonator means.

13. A method of generating a sound directionally discernible to the human ear comprising the steps of:

providing a resonator responsive to an A.C. signal and having resonant frequency in excess of 1200 Hz;

supplying a variable frequency A.C. signal to said resonator to generate an audible sound;

frequency modulating said A.C. signal at a sweep rate over a frequency bandwidth that includes said resonant frequency; and controlling the sweep rate of said frequency modulation across said bandwidth at a rate less than about 1200 Hz.

14. The method according to claim 13, the resonator including a piezoelectric sound element having a resonant frequency of about 2.9 KHz, said frequency modulating step including modulating the frequency over a shift range that includes a range of about 2.0 KHz to 3.8 KHz.

15. The method according to claim 13, said controlling step comprising a sweep rate of about 200–600 Hz.

16. In a personal alert device having means for sensing movement of a wearer, a piezoelectric sound element having a resonant frequency in excess of 1200 Hz and means coupled to the sensing means for determining if normal movement of the wearer has ceased, the improvement comprising an apparatus coupled to the determining means and the sound element for generating a directionally discernible sound when normal movement of the wearer ceases including:

an oscillator circuit for supplying an A.C. signal to the piezoelectric sound element at frequencies modulated at a sweep rate over a frequency shift range that includes the resonant frequency of the piezoelectric sound element, and the sweep rate of the frequency modulation across the shift range being less than 1200 Hz.

17. The improvement according to claim 16, wherein the resonant frequency is about 2.9 KHz and the shift range is about 2.9 KHz+or −500 Hz.

18. The improvement according to claim 16, wherein the sweep rate is in the range of 200–600 Hz.

* * * * *

UNITED STATES PATENT AND TRADEMARK OFFICE

CERTIFICATE OF CORRECTION

PATENT NO. : 4,926,159

DATED : May 15, 1990

INVENTOR(S) : Alan L. Bartlett

It is certified that error appears in the above—identified patent and that said Letters Patent is hereby corrected as shown below:

Claim 7, line 23, column 11, after "frequency shift" insert --range--.

Signed and Sealed this

Sixteenth Day of July, 1991

*Attest:*

*Attesting Officer*

HARRY F. MANBECK, JR.

*Commissioner of Patents and Trademarks*